US008336637B2

(12) United States Patent
Alsaffar

(10) Patent No.: US 8,336,637 B2
(45) Date of Patent: Dec. 25, 2012

(54) FIRE EXTINGUISHING SYSTEM FOR HYDROCARBON STORAGE TANKS

(76) Inventor: Abdulreidha Abdulrasoul Alsaffar, Mubarak Alkabeer (KW)

( * ) Notice: Subject to any disclaimer, the term of this patent is extended or adjusted under 35 U.S.C. 154(b) by 121 days.

(21) Appl. No.: 12/897,017

(22) Filed: Oct. 4, 2010

(65) Prior Publication Data

US 2012/0080203 A1 Apr. 5, 2012

(51) Int. Cl.

| | |
|---|---|
| ***A62C 37/10*** | (2006.01) |
| ***A62C 35/00*** | (2006.01) |
| ***A62C 8/00*** | (2006.01) |
| ***A62C 3/06*** | (2006.01) |

(52) U.S. Cl. ..... 169/60; 169/16; 169/48; 169/56; 169/66; 169/68

(58) Field of Classification Search ..... 169/16, 169/48, 56, 60, 66, 67, 68, 69
See application file for complete search history.

(56) References Cited

U.S. PATENT DOCUMENTS

| | | | | |
|---|---|---|---|---|
| 2,725,943 | A | 12/1955 | Grosshein | |
| 4,664,199 | A | 5/1987 | Grant | |
| 4,781,252 | A | 11/1988 | Wilburn | |
| 4,893,681 | A | 1/1990 | Flandre | |
| 5,163,517 | A * | 11/1992 | Kozai et al. | 169/60 |
| 5,377,765 | A | 1/1995 | Kaylor | |
| 5,464,065 | A | 11/1995 | Kaylor | |
| 5,573,068 | A * | 11/1996 | Sharma et al. | 169/68 |
| 6,186,241 | B1 * | 2/2001 | Murr | 169/60 |
| 6,237,694 | B1 * | 5/2001 | Chan | 169/43 |

* cited by examiner

*Primary Examiner* — Ryan Reis
(74) *Attorney, Agent, or Firm* — Lowe Hauptman Ham & Berner, LLP

(57) ABSTRACT

A fire extinguishing system for a floating or fixed roof hydrocarbon or petro chemical storage tank includes an above-ground storage tank having a cylindrically shaped upwardly extending annular wall and a floating or fixed roof on top of the storage tank. The tank also includes a sensor for detecting fire or smoke in the above-ground storage tank and a mass of fire extinguishing materials and a dispenser for dispensing the fire extinguishing materials inwardly across the top of the storage tank upon sensing a fire within the tank. Further, a sub-terrian tank having a capacity greater than the capacity of the above-ground storage tank is disposed below the above-ground storage tank and is connected to the above-ground storage tank so that the hydrocarbon or petro chemical liquid from the bottom of the above-ground storage tank can be almost immediately emptied into the sub-terrain storage tank.

2 Claims, 2 Drawing Sheets

FIRE EXTINGUISHING SYSTEM FOR HYDROCARBON STORAGE TANKS

FIELD OF THE INVENTION

This invention relates to a fire extinguishing system for natural gas and/or petro chemical storage tanks and more particularly to a fire extinguishing system with a mechanism for draining a storage tank of a major portion of its contents and removing those contents from the vicinity of a fire.

BACKGROUND FOR THE INVENTION

Fire fighting apparatus for floating roof and petro chemical storage tanks are well known and have been in use for many years. For example, a U.S. Patent of Flandre, U.S. Pat. No. 4,893,681 discloses a Firefighting Installation For Floating Roof Hydrocarbon Storage Tanks. As disclosed the installation includes a series of vertical pipes disposed regularly around the tank. A sprayer at the top of each pipe is adapted to form a flat jet of extinguishing foam directed towards the interior of the tank along its inside wall. A pressurized water supply is connected to the pipes through an emulsifying agent feed system. An air injector on each pipe near the sprayer favors the formation of the foam. Each sprayer includes two nozzles set at an angle to each other and directed towards the floating roof. Each nozzle incorporates a longitudinal slot in its end portion opposite the free end and facing towards the floating roof.

A Method and Means for Extinguishing Tank Fires is also disclosed in a U.S. Pat. No. 5,377,765 of Kaylor. As disclosed therein, a method and means wherein fires in tanks storing combustible liquids are extinguished by injecting a mixture of water, a foam-forming concentrate and an inert gas into the tank at a point below the surface of the stored liquid forming an up-welling foam column which explodes upon the liquid surface and spreads across that surface to extinguish the fire and prevent its reigniting.

A further approach to a method for extinguishing tank fires is disclosed in a further patent of Kaylor, U.S. Pat. No. 5,464,065. This patent discloses a Method for Extinguishing Tank Fires wherein the fires in tanks storing combustible liquids are extinguished using water from a settled layer at the tank bottom to form a foam that is transported to the top of the combustible liquid by the lifting action of an inert gas stream introduced into the tank at a location below the liquid surface. A stream of water is removed from the tank, mixed with a foam-forming concentrate, merged with a flowing stream of inert gas, and circulated back to the tank at a point below the surface of the stored liquid to form an upwelling foam column which explodes upon the liquid surface and spreads across that surface to extinguish the fire and prevent its reigniting.

Finally, a U.S. Patent of Sharma et al, U.S. Pat. No. 5,573,068 discloses an apparatus for extinguishing fires in oil storage tanks that uses either foam or dry chemical powder, or both as the extinguishant. The device comprises at least one annular pipe ring arranged in a horizontal plane just above the bottom of the storage tank and connected to a supply of extinguishant. When more than one ring is used, the rings are concentrically and equidistantly arranged with the outermost ring connected to the supply of extinguishant. The pipes have two or more diametrically connected cross-members. Vertically extending discharge pipes are situated at the junctions of the pipe rings and cross-members. The top ends of the discharge pipes are above the highest level of flammable liquid in the storage tank and are equipped with discharge nozzles.

The discharge nozzles provide for uniform discharge of the extinguishant onto the surface of the flammable liquid held in the storage tank.

Notwithstanding the above, it is presently believed that there is a need and a potential commercial market for a fire extinguishing system for oil storage tanks and the like in accordance with the present invention. There should be a demand and a commercial market for such systems because the systems and apparatus have the advantage of quickly removing a majority of the flammable material from the proximity of the fire and providing safe storage until the fire is extinguished.

BRIEF SUMMARY OF THE INVENTION

In essence a fire extinguishing system for a hydrocarbon storage tank contemplates an above-ground hydrocarbon storage tank having a generally cylindrically shaped upwardly extending annular wall and a floating or fixed roof on top of the storage tank. Means for sensing a fire in the above-ground storage tank is also provided and a mass of fire extinguishing material, as for example foam and/or dry powder, is provided together with means for dispensing the fire extinguishing material inwardly across the outer edges and an upper portion of the roof upon sensing a fire within a tank.

A sub-terrain tank having a capacity greater than the above-ground storage tank is disposed below the above-ground storage tank together with means for conveying a hydrocarbon from the bottom of the above-ground storage tank into the sub-terrain storage tank. It is also contemplated that the sub-terrain storage tank may include an inert gas across an upper surface thereof and a vent for allowing a portion of the inert gas to be exhausted as the sub-terrain storage tank is filled with the hydrocarbon.

The invention will now be described in connection with the accompanying drawings wherein like reference numerals have been used to indicate like parts.

DESCRIPTION OF THE PREFERRED EMBODIMENTS OF THE INVENTION

Figure 2:
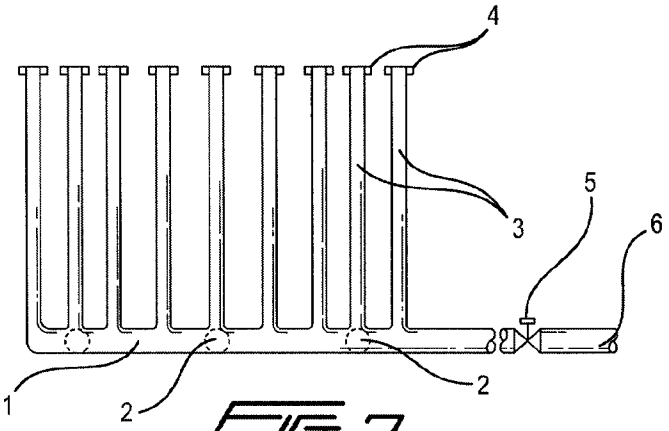
FIG. 2 (PRIOR ART)
FIG. 2 is a schematic illustration of a portion of the prior art fire extinguishing system shown in FIG. 1.

A conventional system for extinguishing fire in oil storage tanks includes at least one horizontally placed annular pipe ring 1. The number of pipe rings 1 depends on the diameter of the storage tank which is to be protected against fire hazards. The minimum/maximum number of annular pipe rings 1 is determined by the cube root or the nearest whole number of the diameter of the storage tank in meters. The diameter of the rings 1 depend on the storage tank 7's base diameter. The outermost annular ring 1 is fixed at a minimum distance of 10 to 20 centimeters from the tank 7 wall. In the case of multiple annular pipe rings the inner annular rings 1 are fixed at an equal distance from each other. The annular pipe rings 1 are fixed horizontally at a distance in the range of 0.15 meter to 5.0 meters from the bottom of the storage tank 7. The annular pipe rings 1 are connected diametrically by cross-member pipes 2 for uniform distribution of foam/dry chemical powder to all of the vertical discharge pipes 3. The number of cross-member pipes 2 is two times the number of annular pipe rings 1. At the junction of the annular pipe rings 1 and the cross-member pipes 2 are fixed to vertical discharge pipes 3 for carrying and discharging the foam/dry chemical powder onto the surface of the flammable liquid 15 stored in the tank 7. The height of the vertical discharge pipes 3 is such that the top ends of the pipes 3 are in the range of 15 cm to 30 cm above the highest level 14 of the flammable liquid 15 in the storage tank 7. At the top ends of the vertical discharge pipes 3 are fixed to discharge nozzles 4 for uniform discharge of foam/dry chemical powder.

The type of discharge nozzles 4 used in the case of foam extinguishing is of the size ranging from 100 mm to 200 mm. The type of discharge nozzle 4 used in the case of dry chemical powder extinquishant is of the size ranging from 25 mm to 50 mm. The annular pipe rings 1 are connected to a valve 5 to foam generator 6 or a dry chemical powder discharge arrangement 6.

Figure 1:
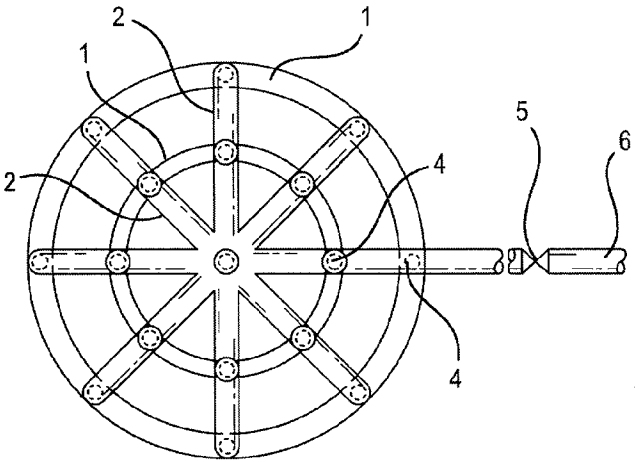
FIG. 1 (PRIOR ART)
FIG. 1 is a top or plan view of a prior art apparatus for extinguishing fires in oil storage tanks.

The annular pipe rings 1, cross-member pipes 2, vertical discharge pipes 3, discharge nozzles 4, valve 5, foam generator 6 or a dry chemical powder discharge arrangement 6 and pipe fittings and accessories used in the construction of the device are shown in FIGS. 1 and 2. FIG. 2 is a schematic illustration of a portion of the prior art fire extinguishing system shown in FIG. 1.

In cases of large scale fires in flammable liquid storage tanks, foam is typically used as an efficient fire extinguishing agent. Foam is an aggregate of inner-formed bubbles formed from aqueous solutions and is lower in density than the flammable liquids. Foam is known for its fire knock-down capability and for blanketing the flammable liquid surface upon which it is applied. It is principally used to form a coherent flaming blanket on flammable and combustible liquids and prevents or extinguishing fire by excluding air and cooling the fuel. It also prevents re-ignition by suppressing formation of flammable vapors and has the property of adhering to surfaces providing a degree of exposable protection from adjacent fires. Foam may be used as a fire prevention, control or extinguishing agent for flammable liquid storage tanks or processing areas. In a typical installation foam or dry chemical is supplied by a fixed piping arrangement either by a top surface application or by sub-surface/semi-subsurface applications.

Dry chemical powder distinguisher is also used mainly for knocking-down the flammable liquid fires. Dry chemical powder is a fine amorphous mixture which is used as a fire extinguishing agent. The principle base chemical used in production of dry chemical extinguishing agents are sodium bicarbonate, potassium bicarbonate, potassium chloride, urea potassium bicarbonate and monoammonium phosphate. Various additives are mixed with these base materials to improve their storage, flow, and water repellency characteristics. The most commonly used additives are metallic stearates, tricalcium phosphate, or silicones, which coat the particles of dry chemical powder to make them free flowing and resistant to the caking effects of moisture and vibration.

A combination of foam and dry chemical powder is also used for extinguishment of flammable liquid fires in storage tanks. Such combinations are used either for top surface or subsurface/semi-subsurface applications.

Figure 3:
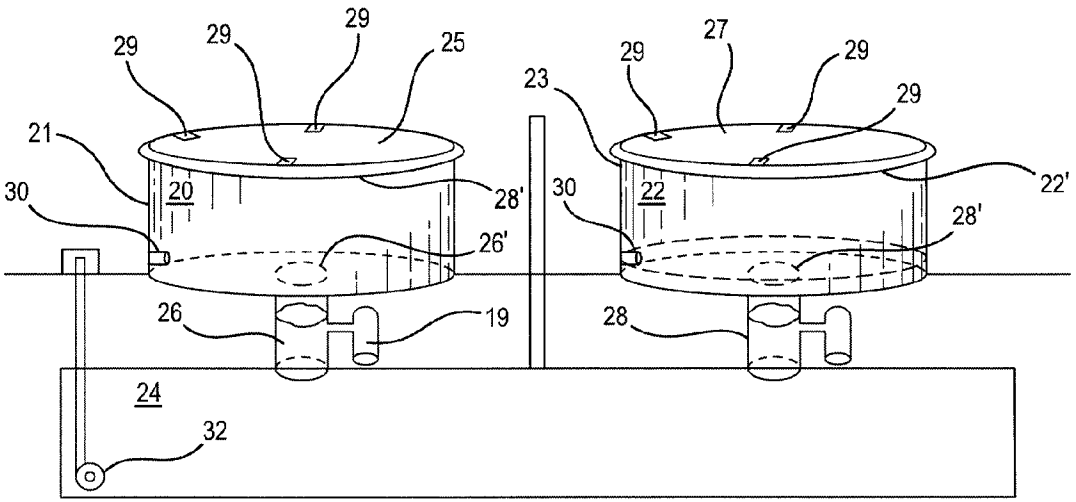
FIG. 3 is a schematic illustration of a above-ground storage tank and a sub-terrain tank disposed below the above-ground tank for receiving a majority of the liquid from the above-ground tank to remove the flammable material from the vicinity of a fire.

FIG. 3 is a schematic illustration of a above-ground storage tank and a sub-terrainian tank disposed below the above-ground tank for receiving a majority of the liquid from the above-ground tank to remove the flammable material from a fire.

The fire extinguishing system in accordance with the preferred embodiment of the invention will now be described in reference to FIG. 3. As illustrated, the system includes a plurality of above-ground storage tanks 20 and 22 (only two shown) for storing gasoline or other refinery product. The tanks 20 and 22 have a generally cylindrical shape with upperwardly extending annular walls 21 and 23 and fixed or floating roofs 25 and 27. The tanks are generally conventional and have a diameter of up to about 45 meters.

A plurality of fire and/or smoke detectors 29 are provided around a top portion of the tanks 20 and 22 and a mass of fire extinguishing materials such as a fire extinguishing foam or dry chemical powder is disposed around the base of each storage tank as for example shown in the U.S. Pat. No. 5,573,068. The foam or dry chemical may be provided as shown in FIG. 2 and delivered to a top of the tank by the pipes 3 and discharge nozzles 4.

An important aspect of the present invention resides in a sub-terrain tank 24 that is shown as being disposed underneath the two storage tanks 20 and 22. The tank 24 is connected to the tanks 20 and 22 by the pipes 26' and 28' respectively that are connected by valves 26 and 28 and have relatively large diameter as for example 23 inches. Upon sensing a fire, the valves 26 and 28 are immediately opened in order to discharge a majority of the flammable liquid into the lower tank 24.

In the preferred embodiment of the invention a liquid level detector 30 is disposed in each storage tank to sense that the level of flammable liquid is approaching the bottom of a tank in order to close the valves 26 and 28 before the fire reaches the pipes 26 and 28. As shown, the pipes 26' and 28' may be filled with an inert gas which can also be provided across the top of tank 24 to prevent fire from reaching the liquid in the lower tank.

Figure 4:
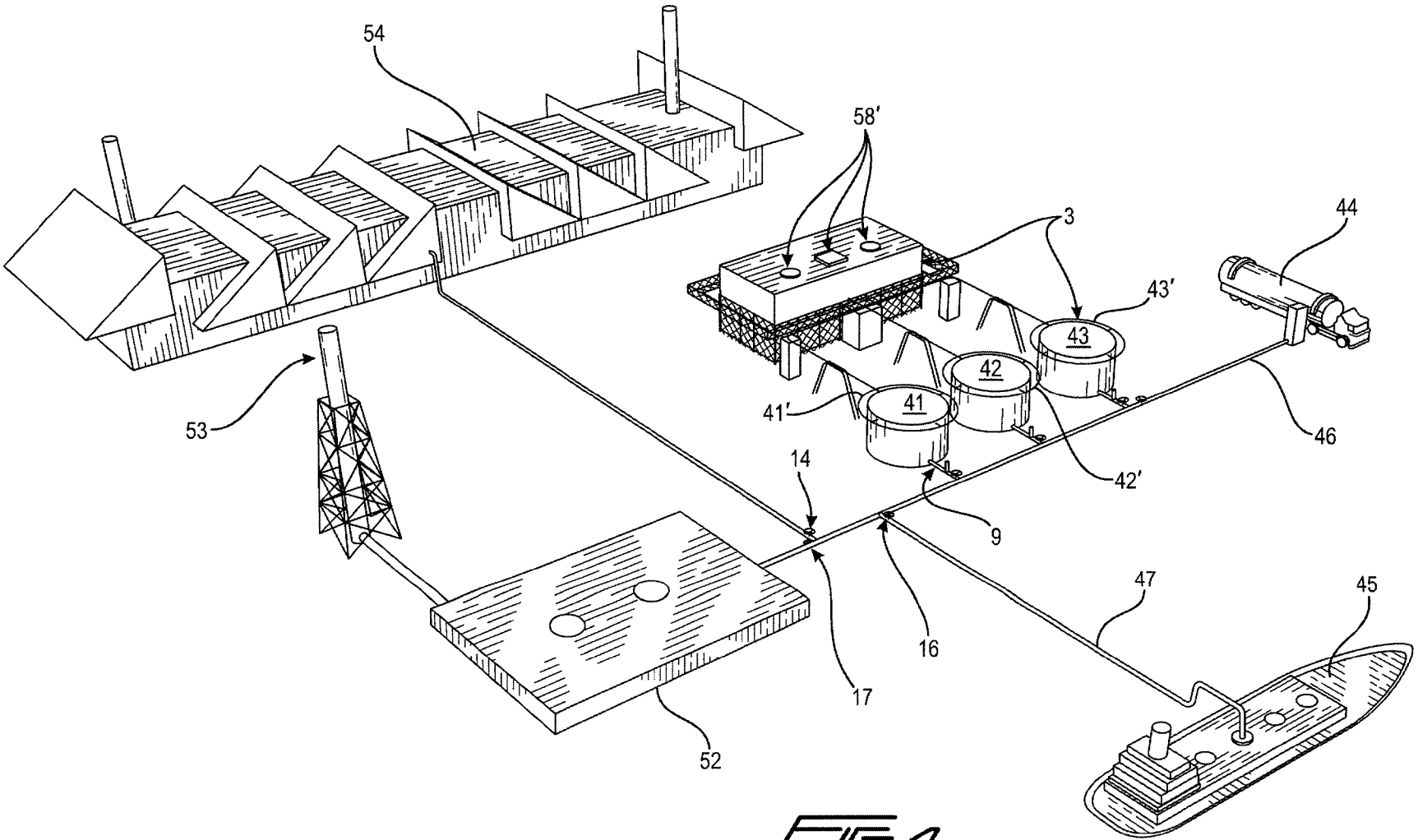
FIG. 4 is a perspective view of a fire extinguishing system for a plurality of hydrocarbon storage tanks in accordance with a preferred embodiment of the invention.

A further preferred embodiment of the invention is illustrated in FIG. 4 that includes a plurality of storage tanks 41, 42, and 43 which are used to store flammable liquid above a platform (not shown). The storage tanks 41, 42 and 43 are constructed on a strong platform and used to provide the liquid to a truck 44 or ship 48 by a pipe 46 and/or pipe 47. Each of the storage tanks also includes an upper ring 41', 42' and 43' for delivering a supply of foam and/or dry chemical extinguishing material to each of the storage tanks 41, 42 and 43.

At the bottom of each of the tanks 41, 42 and 43 is one or more large valves with openings of at least 12 inches that can be opened in the case of a fire to discharge the flammable liquid from each tank. A large diameter major tank extends with a 20 inch diameter that goes to all of the oil tanks in the field is connected to a major lower tank 52, means of valves and a plurality of level indicators such as sight glasses are provided to close the valves when the liquid reaches that level.

A key element in the project is a large underground tank 52 with five to seven above-ground oil tanks 41-43 are also provided and is used to burn off the vaporizing liquid at stack 53 to thereby reduce the smell from the tanks and to avoid the pollution of the environment as well as for security cases and emergencies. The advantages of the main pipe which is connected to the oil tanks is that it can be connected to a factory 54 for oil production and/or refinery and for filling the tanks with the crude oil for an off sight destination.

It should be noted that in case of any fire in any of the oil tanks, all of the tanks should be emptied into the below ground tank and closed.

The fire extinguishing system in accordance with a preferred embodiment of the invention includes a storage facility or basin 58 preferably at or below the storage tanks 41, 42 and 43 but shown adjacent to storage tanks for storing a mass of fire extinguishing material i.e. the foam or dry chemical and means for pumping the fire extinguishing material up to and out of one of the rings 41', 42', or 43' upon sensing a fire by one of three sensors 58'. Further, in a preferred embodiment of the invention the sub-terrainian tank is disposed immediately below the storage tanks 41-43 even though shown for convenience as offset therefrom.

While the invention has been described in connection with its preferred embodiment it should be recognized that changes and modifications may be made therein without departing from the scope of the appended claims.

What is claimed is:

1. A fire extinguishing system for a plurality of hydrocarbon or petro chemical storage tanks comprising:

a plurality of above-ground hydrocarbon storage tanks having a cylindrically shaped upwardly extending annular wall and a roof on top of each of said storage tanks;

a plurality of fire and smoke detectors provided around a top portion of each of said storage tanks;

means for sensing a fire or smoke in said above-ground storage tank;

a mass of fire extinguishing material disposed around the base of each storage tank and means for dispensing said fire extinguishing material inwardly around an outer upper edge at an upper portion of said roof upon sensing a fire within one of said storage tanks; and wherein said means for dispensing said fire extinguishing material includes a plurality of upwardly extending pipes and nozzles disposed around an upper portion of said upwardly extending annular walls;

a sub-terrainian tank having a capacity greater than the capacity of the above-ground storage tanks disposed below said above-ground storage tanks and means for conveying the hydrocarbon or petro chemical from the bottom of said above-ground storage tanks and into said sub-terrainian storage tank; and wherein said sub-terrainian tank includes a vent for burning escaping fumes to reduce the smell of oil;

wherein said sub-terrainian tank is connected to each of said plurality of above-ground storage tanks by pipes and valves that have diameters of at least 12 inches and wherein said valves are immediately opened upon sensing a fire or smoke in one of said plurality of storage tanks to discharge a majority of the hydrocarbon or petro chemical into said sub-terrainian tank;

and in which said sub-terrainian storage tank includes an inert gas across an upper surface thereof and said vent allows a portion of said inert gas to be exhausted as the sub-terrainian storage tank is filled with hydrocarbon or petro chemical;

a plurality of liquid level detectors with one of said detectors disposed in each of said above-ground storage tanks to sense the liquid of hydrocarbon or petro chemicals is approaching the bottom of said storage tank and close one of said valves before a fire reaches said valve.

2. A fire extinguishing system for a petrochemical storage tank consisting of:

a plurality of above ground storage tanks and each of said storage tanks having a cylindrical shaped upwardly extending annular wall and a roof having an upper edge around the top of said annular wall;

a plurality of fire and smoke detectors provided around a top portion of each of said storage tanks for sensing a fire or smoke in one of said storage tanks;

a mass of fire extinguishing material disposed around the base of each storage tank and means for dispensing said fire extinguishing material inwardly around an outer upper edge of an upper portion of said roof upon sensing a fire within one of said storage tanks; and wherein said means for dispensing said fire extinguishing material includes a ring and a plurality of upwardly extending pipes and nozzles disposed around an upper portion of said upwardly extending annular wall;

a sub-terrainian tank having a capacity greater than the capacity of the above ground storage tanks disposed below said above ground storage tanks and means conveying the hydrocarbon or petrochemical from the bottom of said above ground storage tank and into said sub-terrainian storage tank; and in which said sub-terrainian storage tank includes an inert gas across an upper surface thereof and a vent for allowing a portion of said inert gas to be exhausted as the sub-terrainian storage tank is filled with hydrocarbon or petro-chemical; and said sub-terrainian storage tank includes said vent for burning escaping fumes to reduce the smell of oil.

* * * * *